United States Patent [19]

Hasegawa

[11] 4,291,876

[45] Sep. 29, 1981

[54] FRP RACKET FRAME

[75] Inventor: Shigeji Hasegawa, Chiba, Japan

[73] Assignee: Hasegawa Chemical Industry Co., Ltd., Chiba, Japan

[21] Appl. No.: 121,053

[22] Filed: Feb. 13, 1980

[30] Foreign Application Priority Data

Feb. 22, 1979 [JP] Japan ..... 54-20074

[51] Int. Cl.[3] ..... A63B 49/02

[52] U.S. Cl. ..... 273/73 F

[58] Field of Search ..... 273/67 R, 73 R, 73 C, 273/73 F, 73 K, 76, DIG. 7, 23, 68, 72 R; 124/23 R; 156/152; 144/309 H, 309 Q, 310 A, 310 B; 280/610, 819

[56] References Cited

U.S. PATENT DOCUMENTS

| | | | |
|---|---|---|---|
| 1,831,350 | 11/1931 | Hall | 273/73 F |
| 2,029,193 | 1/1936 | Reach | 273/73 F |
| 2,178,588 | 11/1939 | Kleinman | 273/73 F X |
| 2,665,678 | 1/1954 | Bear | 273/DIG. 7 |
| 2,878,020 | 3/1959 | Robinson | 273/73 F |
| 3,889,951 | 6/1975 | Schaefer et al. | 273/73 F |
| 4,023,799 | 5/1977 | Van Auken | 273/73 F |
| 4,070,019 | 1/1978 | Segal et al. | 273/73 F |

FOREIGN PATENT DOCUMENTS

| | | | |
|---|---|---|---|
| 21151 | 1/1935 | Australia | 273/73 F |
| 51-19630 | 8/1976 | Japan . | |
| 1312731 | 4/1973 | United Kingdom | 273/73 F |

*Primary Examiner*—Richard J. Apley

*Attorney, Agent, or Firm*—Brumbaugh, Graves, Donohue & Raymond

[57] ABSTRACT

A racket frame formed of a frame core and FRP sheets adhered to ball-striking faces of the frame core. The present racket frame is so constructed such that each of the FRP sheets is made by slicing a laminated body consisting of a plurality of FRP plate elements and protective plates which laminated body is molded into the same configuration as that of the ball-striking faces of the frame core, each of the FRP plate elements is formed by long, continuous reinforcing rovings extending from one end to the other end of the plate element and being uniformly impregnated into the thermosetting resin under uniform tension, and said protective plates are arranged at the innermost and outermost sides of the molded laminated body.

1 Claim, 7 Drawing Figures

FRP RACKET FRAME

This invention relates to a racket frame for tennis or badminton in which ball-striking faces of a frame core are strengthened by FRP sheets.

In order to increase the ball bounce properties of the racket frame, several types of FRP racket frames have been developed. In one typical construction of the conventional FRP racket frame, the frame core is strengthened by an elongate FRP strip adhered onto the peripheral side face of the frame core. The merit of the FRP racket frame of this type is that it is possible to use an elongate FRP strip, since the peripheral side face of the frame core can be easily strengthened by bending the elongate FRP strip in its thickness direction, that is, its easily bendable direction. On the other hand, the fault of the racket frame of this type is that the FRP strips cannot provide sufficient rigidity especially in the radial direction to the annular portion of the frame in which the gut strings are stretched. Therefore, the annular portion of the frame is liable to be deformed by the tension of the gut strings when they are tightened over the annular portion of the frame. This makes it impossible to tighten the gut strings with strong tension and therefore excellent ball bounce properties cannot be expected.

In another typical construction of the conventional FRP racket frame, the ball-striking faces of the frame core are strengthened by FRP sheets. In this type, it is impossible to use a straight FRP strip, since straight FRP strips cannot be bent in their width direction. Therefore, the FRP members to be adhered onto the ball-striking faces of the frame core are usually formed by punching from an FRP thin plate having a large area. However, according to this punching formation of the FRP members from the FRP thin plate, large dead spaces are left in the original FRP thin plate and this is not economical. Another fault of this punching formation of the FRP members is that the reinforcing fibers in each FRP member are cut into short lengths especially in the annular portion. This reduces the spring properties of the FRP member itself and therefore the ball-bounce properties of the racket frame cannot be increased by such an FRP member.

In the Japanese laid-open patent publication No. 19630/1976, it is disclosed that the ball-striking faces of the frame core are strengthened by firstly laying, along the ball-striking faces of the frame core, a prepreg wherein long, continuous glass or carbon fibers are impregnated under non-stress condition, and then by heating and pressing the prepreg onto the ball-striking faces of the frame core. However, according to this method, it is impossible to give prestress to the reinforcing fibers and therefore the spring properties of the racket frame and thus the ball bounce properties of the racket frame cannot be increased.

Further, all of the conventional FRP strengthened racket frames have the following faults: firstly there is always the danger that the reinforcing fibers will stick into the fingers of the tennis or badminton player, secondly the corner portion of the racket frame is often damaged when the racket frame is struck against the ground, and thirdly the cutter used for finish cutting of the frame corner is liable to suffer wear since a reinforcing fiber such as glass or carbon fiber is very hard.

However, the inventor of the present invention found that these faults of the conventional rackets can be solved by providing one or more edge protect layers in the FRP sheet.

It is, therefore, an object of the present invention to provide a FRP racket frame which can eliminate the foregoing faults.

It is a further object of the present invention to provide an FRP racket frame in which the ball-striking faces of the frame core are strengthened by FRP members (sheets) including long, continuous reinforcing rovings uniformly arranged along the entire ball striking faces of the frame core under prestress condition.

It is a further object of the present invention to provide a FRP racket frame remarkably excellent in ball bounce properties and strengthened by FRP sheets formed by multi-layers and having a beautiful appearance in the strengthened faces.

Figure 1:
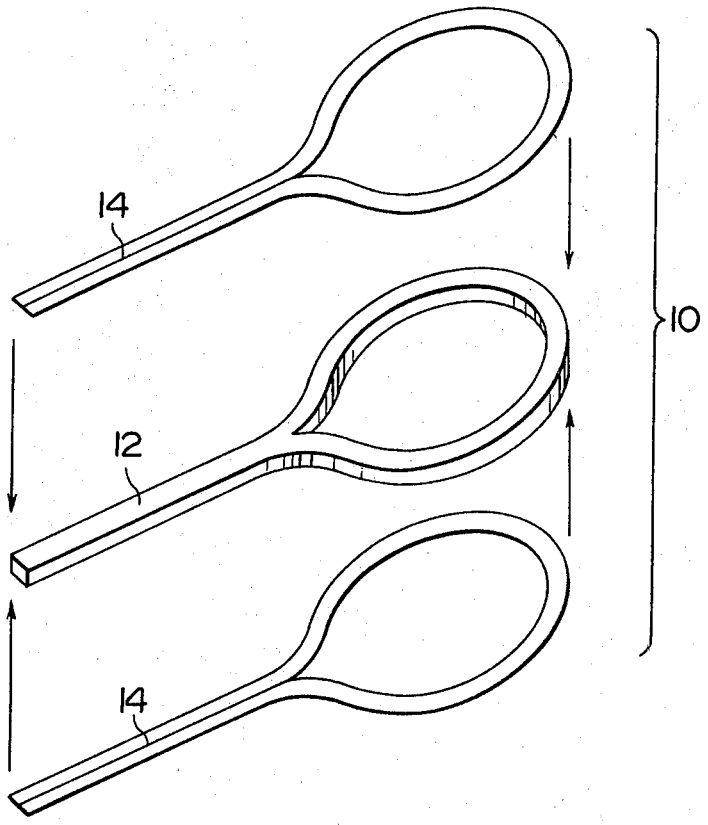
FIG. 1 is a perspective view showing a frame core and FRP sheets adhered to the ball-striking faces of the frame core which frame core and FRP sheets are structural elements of the racket frame of the present invention.
Figure 2:
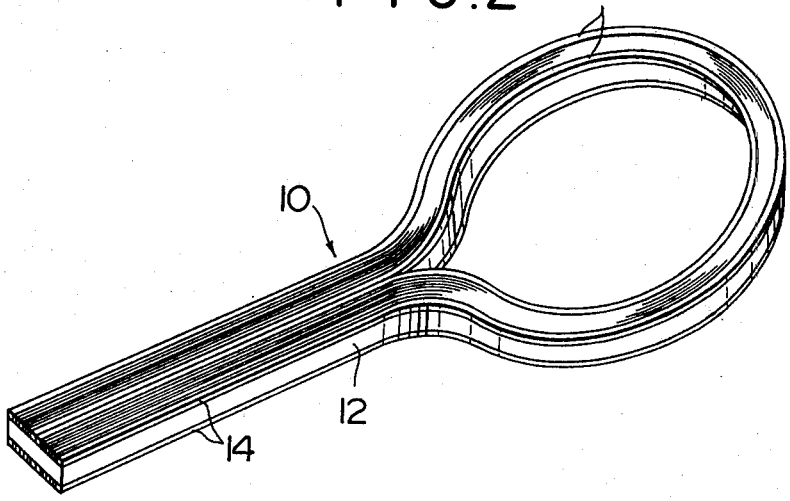
FIG. 2 shows one embodiment of the racket frame according to the present invention in which FRP sheets are adhered onto the entire region of the ball-striking faces of the frame core.
Figure 3:
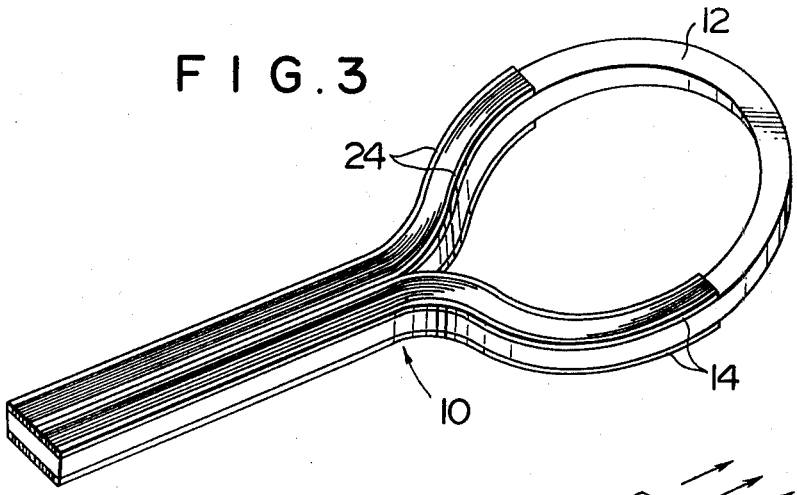
FIG. 3 shows another embodiment of the racket frame according to the present invention in which FRP sheets are adhered onto a part of the ball-striking faces of the frame core.

As shown in FIG. 1, the racket frame 10 of the present invention is made by a frame core 12 of wood or plastic and FRP sheets 14 adhered onto the ball-striking faces of the frame core 12. The FRP sheets 14 may be adhered onto the ball-striking faces of the frame core 12 for covering the entire region thereof as shown in FIG. 2 or may be adhered onto the ball striking faces of the frame core 12 for covering a parts thereof as shown in FIG. 3. The FRP sheet 14 has excellent spring properties and is made by a method hereinafter explained in detail.

Figure 4:
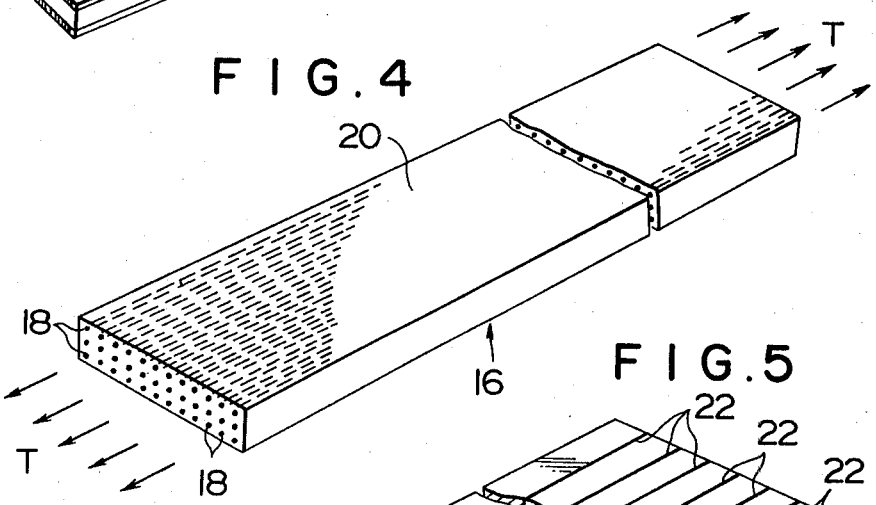
FIG. 4 shows an FRP plate element constituting the FRP sheet adhered to the ball-striking faces of the frame core.
Figure 5:
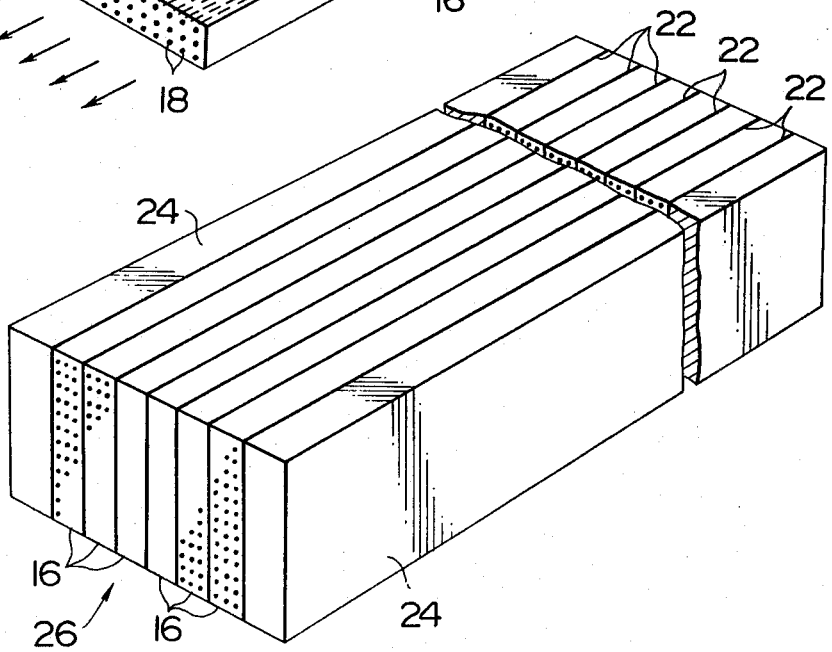
FIG. 5 shows a laminated body consisting of a plurality of the FRP plate elements of FIG. 4 and protective plates arranged at the outermost portions of the laminated body.

First of all, as shown in FIG. 4, the production of the FRP sheet 14 is started by forming FRP plate elements 16 which are components of a laminated body 26 shown in FIG. 5. The FRP plate element 16 is formed firstly by arranging uniformly a plurality of rovings 18 of glass fiber, carbon fiber of KEVLAR (trade mark) fiber and pulling them under uniform tension "T" and then by impregnating thermosetting resin 20 into the rovings 18 and heating the resin to harden it. In the case where the FRP plate elements 16 are used for making the FRP sheets 14 for covering the entire region of the ball-striking faces of the frame core 12 as shown in FIG. 2, the longitudinal length of each of the elements 16 is determined as a length two times the length of the handle portion of the frame core 12 plus the length of the annular portion (ball receiving portion) of the frame core 12.

On the contrary, in the case where the FRP plate elements 16 are used for making the FRP sheets 14 for covering a part of the ball-striking faces of the frame core as shown in FIG. 3, the longitudinal length of each of the elements 16 is determined as the length of the handle portion of the frame core 12 plus the length of the extension toward the annular portion. In the FRP plate elements 16 used for making the FRP sheets 14 for covering the entire region of the ball-striking faces of the frame core 12, the longitudinal length and the thickness and the width of each FRP plate element 16 are determined respectively to be 1,500 mm, 1 mm and 90 mm in the present embodiment.

A predetermined number of the FRP plate elements 16 shown in FIG. 4 are then stacked into a laminated body 26 as shown in FIG. 5 with adhesive 22 therebetween. Protective plates 24 of ABS resin or rubber are further laminated onto the outermost sides of the laminated body 26 by adhesive 22. The adhesive 22 is preferably a thermosetting adhesive such as epoxy resin. The provision of the protective plates 24 produces the effects of: (1) preventing the danger that the reinforcing fibers will stick into the fingers of the tennis or badminton player, (2) preventing the damage of the racket frame when a player strikes the ground at edge portion of the frame and (3) strengthening the life of the cutter used for finish cutting of the edge portion of the racket frame.

Figure 6:
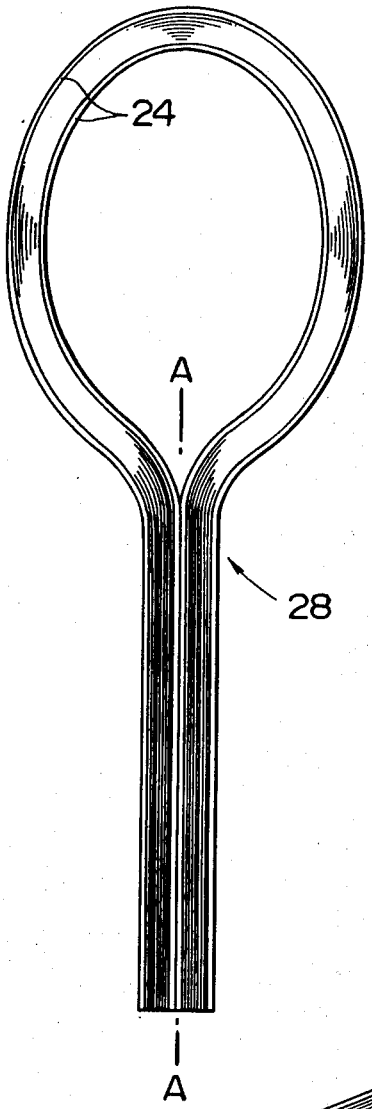
FIG. 6 shows a laminated body formed into the configuration of the racket frame core.

Then the laminated body 26 of FIG. 5 is molded in a metallic or wooden mold (not shown) having the same configuration as that of the frame core 12. In the mold, the laminated body 26 is heated to form a rigid curved body 28 as shown in FIG. 6 by hardening the adhesive 22 between each FRP plate element 16 and the protective plates. In order to adhere the portion A—A of FIG. 6, it is preferable to also apply adhesive at this portion prior to the heating operation.

The curved laminated body 28 is then taken off the mold and thus rigid laminated body 28 having the same configuration as the ball-striking face of the frame core 12 can be formed.

Figure 7:
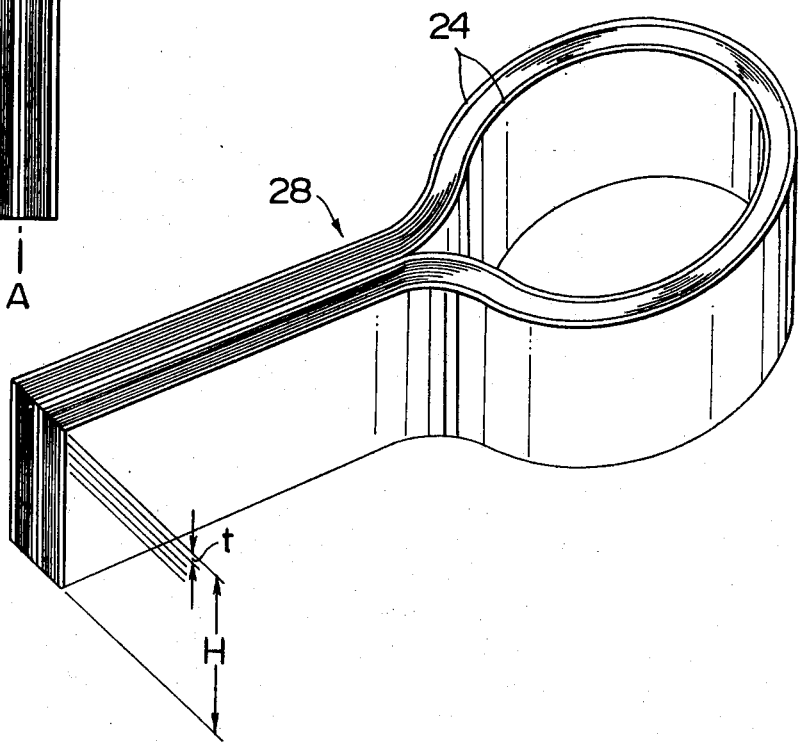
FIG. 7 is a perspective view of the laminated body of FIG. 6 for explaining the method for making the FRP sheets shown in FIG. 1.

As shown in FIG. 7, the rigid laminated body 28 is sliced into a great many FRP sheets 14 shown in FIG. 1. In the present embodiment, the slicing operation is carried out by using 121 diamond disc cutters (not shown) each having a diameter of 120 mm and a thickness of 0.2 mm and arranged in series at intervals of 0.5 mm. In the embodiment, as the height "H" of the rigid laminated body 28 which corresponds to the width of the FRP plate element 16 of FIG. 4 is 90 mm, 129 FRP sheets 14 the type shown in FIG. 1 each having a thickness "t" of 0.5 mm can be produced by moving the 121 diamond disc cutters along the laminated body 28.

As clearly explained above, each of the FRP sheets 14 of the present invention thus formed has reinforcing rovings 18 each of which is long and continuous and extends from one end of the other end of the FRP sheet 14 and each of which is impregnated in the resin under a uniform tension "T". Therefore, the FRP sheets 14 to be adhered onto the frame core 12 have very high spring properties as compared with the conventional FRP sheets and thus the racket frame 10 of the present invention has very excellent ball bounce properties.

Furthermore, according to the racket frame 10 of the present invention, since protective edge portions 24 of ABS resin or rubber are provided along the periphery of the racket frame, it is very effective in the several points aforementioned.

What is claimed is:

1. In a racket frame comprising a frame core including a handle portion, a throat portion and a head loop portion, and FRP sheets adhered to the ball-striking faces of the frame core, the improved racket frame wherein:

each of said FRP sheets is made by slicing a curved laminated body formed into the same configuration as that of the ball-striking face of the frame core by molding a straight laminated body consisting of a plurality of FRP plate elements and protective plates arranged in side-by-side relation, each of the FRP plate elements is formed by long, continuous reinforcing rovings extending from one end of the plate element to the other end of the plate element and, while under uniform tension, being uniformly impregnated with a thermosetting resin, said protective plates are arranged at the innermost and outermost sides of the curved laminated body, and said FRP sheets are adhered to the ball-striking faces of the frame core at least in a region of said handle portion, said throat portion, and a part of said head loop portion.

* * * * *